United States Patent [19]

Wan et al.

[11] Patent Number: 4,523,950

[45] Date of Patent: Jun. 18, 1985

[54] BORON CONTAINING RAPID SOLIDIFICATION ALLOY AND METHOD OF MAKING THE SAME

[75] Inventors: Chung-Chu Wan, Diamond Bar, Calif.; Rong Y. Wang, Pine Brook; Deepak Kapoor, Saddle Brook, both of N.J.

[73] Assignee: Allied Corporation, Morris Township, Morris County, N.J.

[21] Appl. No.: 318,893

[22] Filed: Nov. 9, 1981

Related U.S. Application Data

[63] Continuation-in-part of Ser. No. 220,618, Dec. 29, 1980.

[51] Int. Cl.[3] ..... F16H 29/10

[52] U.S. Cl. ..... 75/123 B; 75/251; 420/435; 420/441; 420/580; 420/581; 428/606

[58] Field of Search ..... 75/123 B, 126 P, 128 F, 75/128 G, 134 F, 135, 122, 170, 171, 176, 251, 254, 255, 129, 238, 242, 244, 0.5 BA; 428/606; 420/435, 441, 580, 459, 581, 435; 148/40.3

[56] References Cited

U.S. PATENT DOCUMENTS

| | | | |
|---|---|---|---|
| 3,856,513 | 12/1974 | Chen | 75/122 |
| 4,067,732 | 1/1978 | Ray | 75/170 |
| 4,116,682 | 9/1978 | Polk et al. | 75/123 L |
| 4,121,930 | 10/1978 | Yukawa et al. | 75/123 B |
| 4,133,679 | 1/1979 | Ray | 75/123 B |
| 4,133,681 | 1/1979 | Ray | 75/170 |
| 4,133,682 | 1/1979 | Ray | 75/170 |
| 4,152,144 | 5/1979 | Hasegawa et al. | 75/122 |
| 4,152,146 | 5/1979 | Freilich et al. | 75/123 B |
| 4,210,443 | 7/1980 | Ray | 75/123 B |
| 4,221,592 | 9/1980 | Ray | 75/122 |
| 4,260,666 | 4/1981 | DeCristofaro et al. | 75/170 |
| 4,297,135 | 10/1981 | Giessen et al. | 75/129 |
| 4,318,733 | 3/1982 | Ray et al. | 75/126 P |
| 4,365,994 | 12/1982 | Ray | 75/123 B |

*Primary Examiner*—John P. Sheehan

*Attorney, Agent, or Firm*—James Riesenfeld; Gerhard H. Fuchs

[57] ABSTRACT

A homogeneous boron containing alloy is disclosed with a composition which can be essentially represented by the formula of: $M_iT_jB_k$ where M is a metal from the group of nickel, iron, cobalt or a mixture thereof; T is a refractory metal from the group of molybdenum, tungsten, or a mixture thereof; and B is the element boron. The subscripts i, j, k are the respective atomic percent of each of the constituents and vary respectively between about 25 and 98, between about 1 and 40, and between 1 and 35 with the proviso that $j>k$, and $i+j+k=100$. By further limitation of the chemistry, it is possible to assure the alloy will age harden.

5 Claims, 26 Drawing Figures

FIG. 2.1
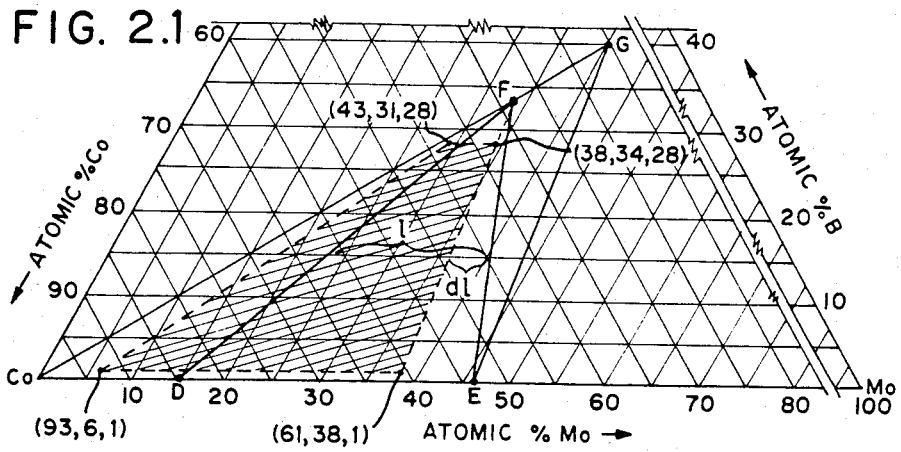
FIG. 2.2
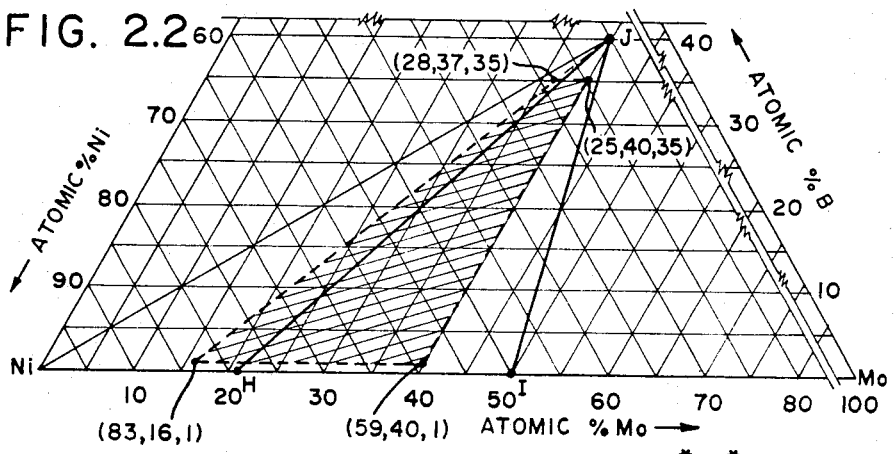
FIG. 2.3
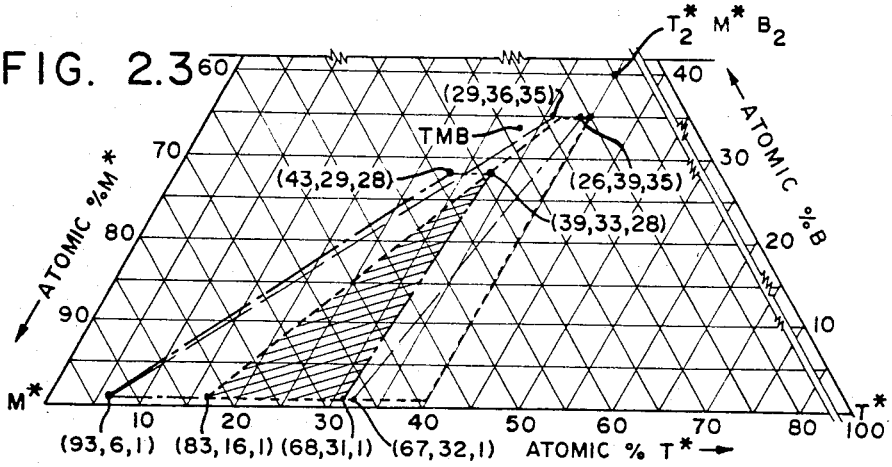

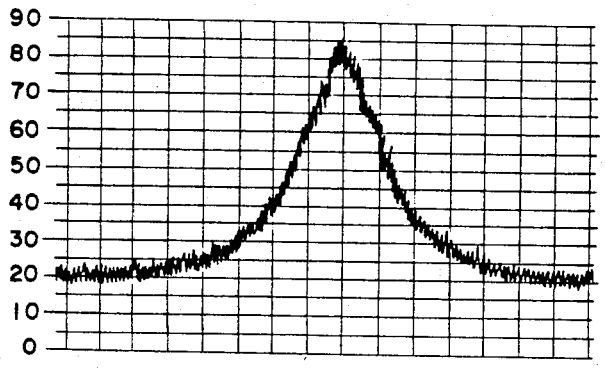
FIG. 3.1
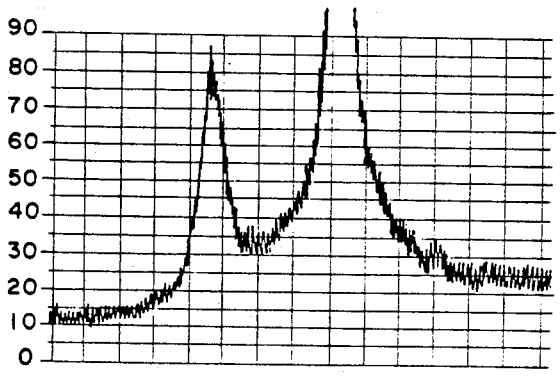
FIG. 4.1

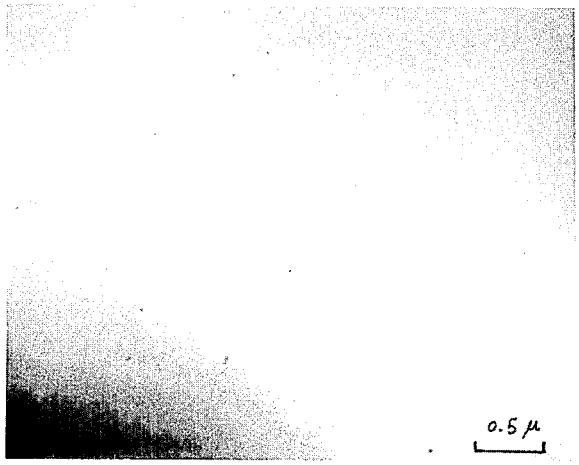
FIG. 3.2
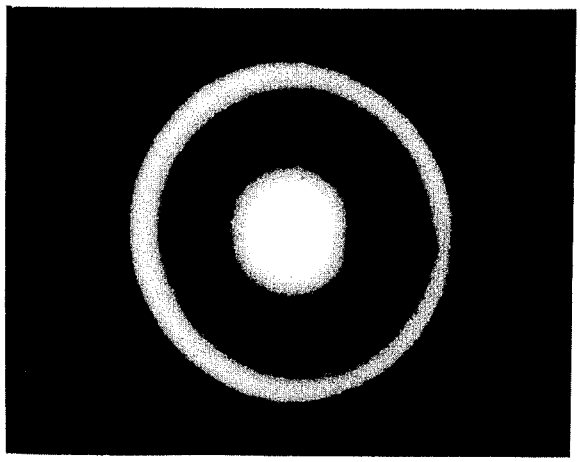
FIG. 3.3
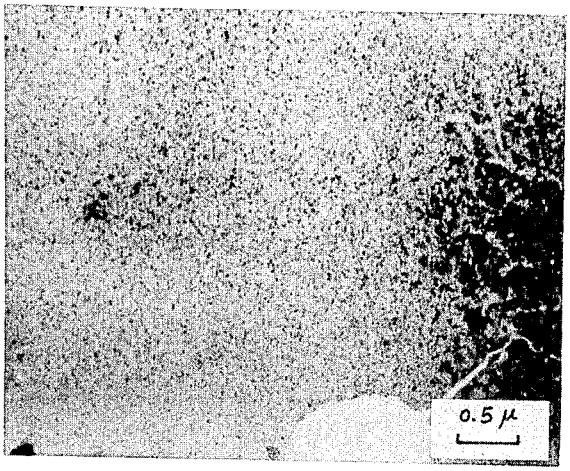
FIG. 4.2

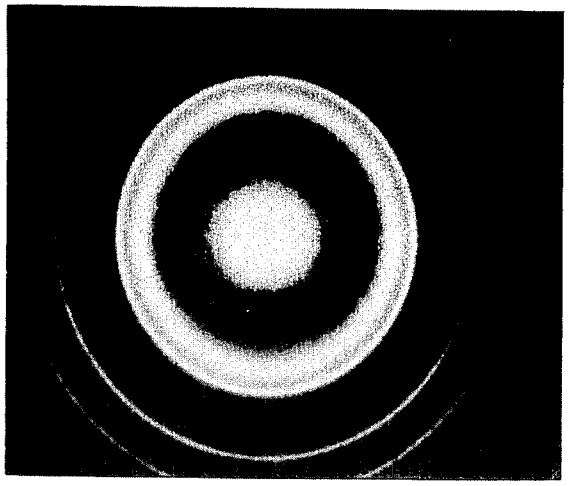
FIG. 4.3
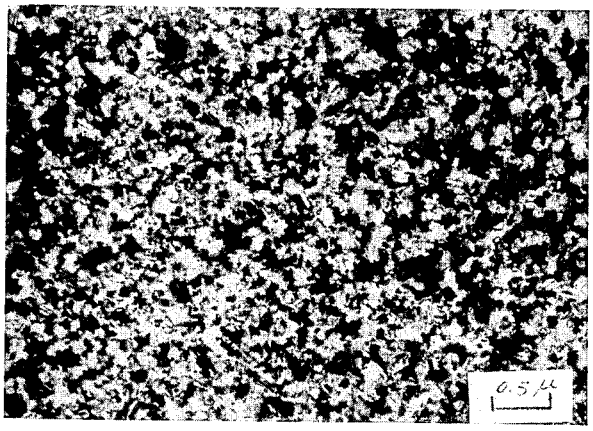
FIG. 5.2
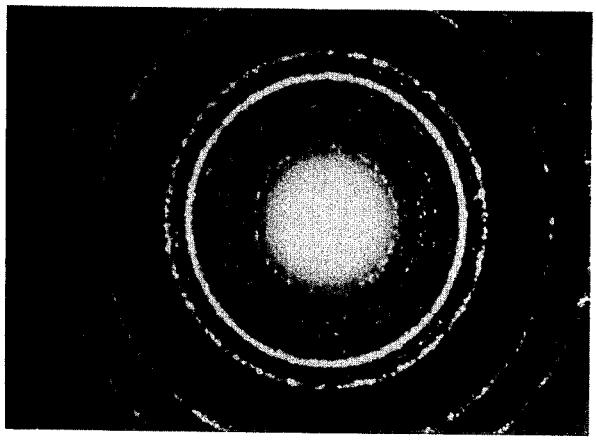
FIG. 5.3

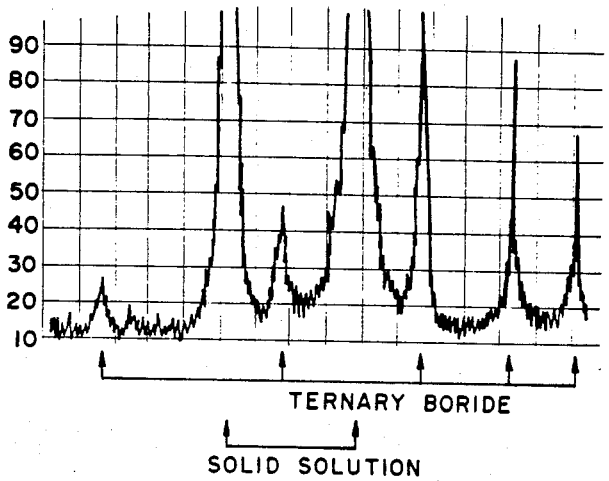
FIG. 5.1
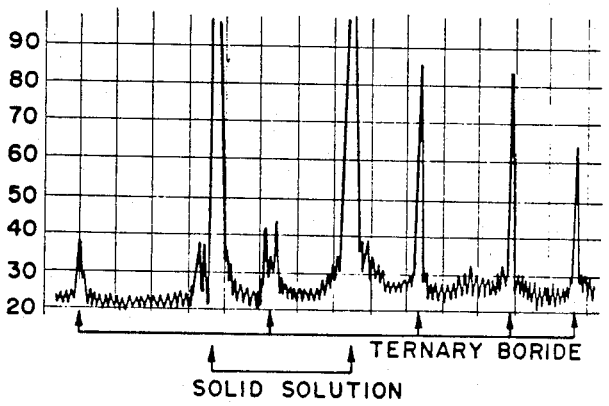
FIG. 8.1

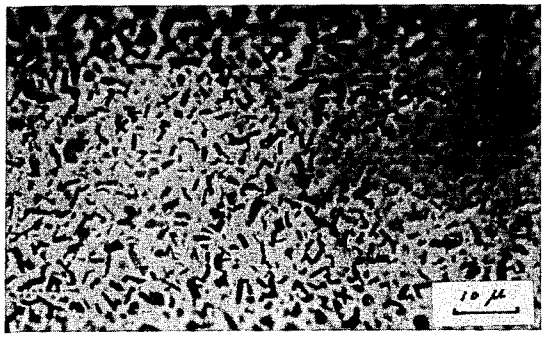
FIG. 7.2
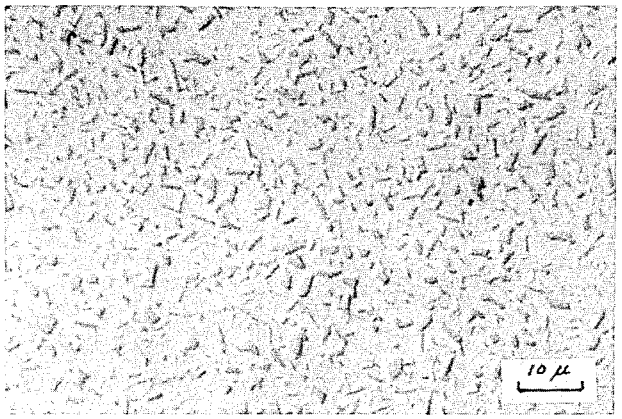
FIG. 9.2
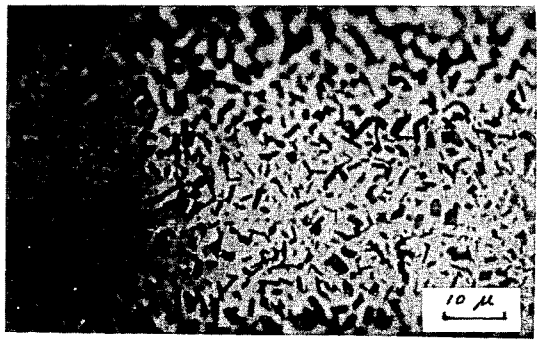
FIG. 7.1
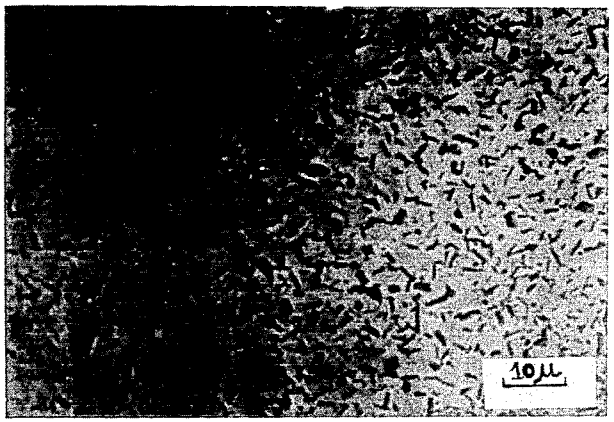
FIG. 8.2

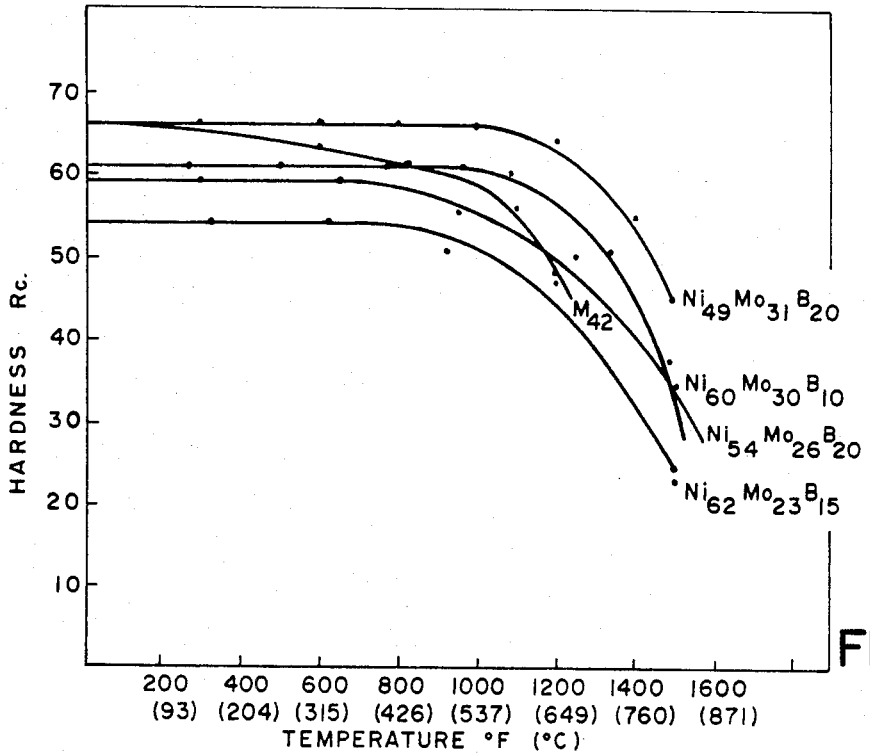
FIG. 12
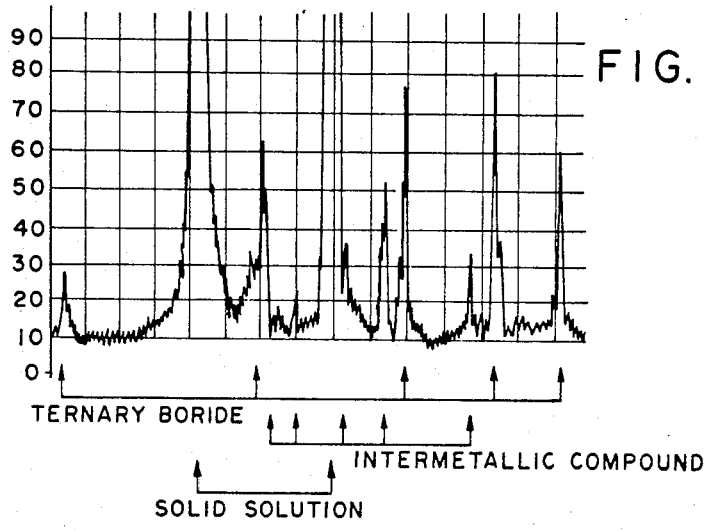
FIG. 9.1

FIG. 11.1
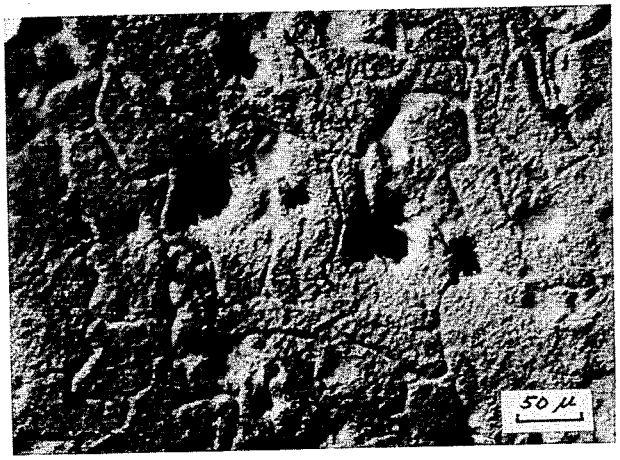
FIG. 11.2
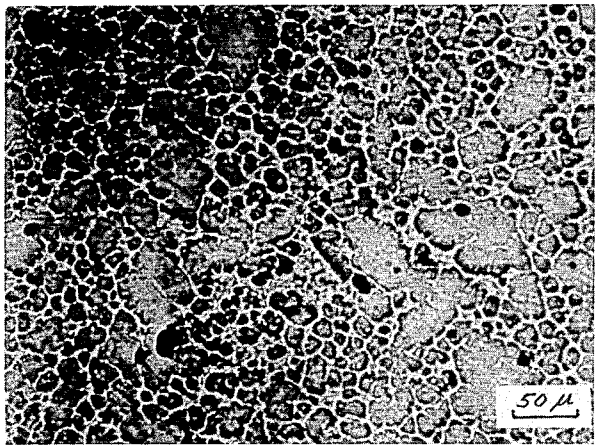
FIG. 10.1
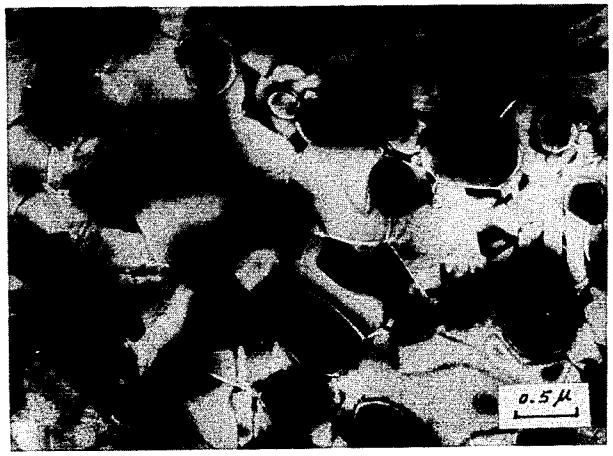
FIG. 10.2
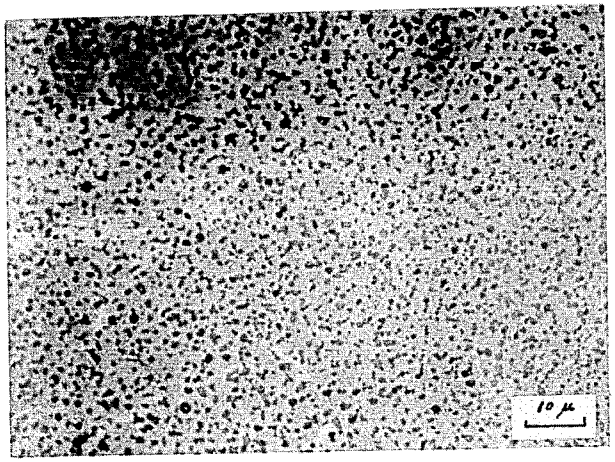

BORON CONTAINING RAPID SOLIDIFICATION ALLOY AND METHOD OF MAKING THE SAME

CROSS-REFERENCE TO PRIOR APPLICATION

This application is a continuation-in-part of application Ser. No. 220,618, filed Dec. 29, 1980.

DESCRIPTION

1. Field of the Invention

The invention relates to a chemically homogeneous alloy, which upon thermo-processing will decompose to form a fine grain matrix having dispersed therein a borides of controlled chemistry which is distributed in small particles. These boride particles are spacially separated and principally located in the grain boundaries.

2. Background Art

The alloys used for production of amorphous metals such as those disclosed by Chen, et al. in U.S. Pat. No. 3,856,513 are chemically homogeneous and upon subsequent thermo-processing decompose. The decomposition products are a function of the alloy chemistry.

Ray in U.S. application Ser. No. 023,379 discloses that the boron containing glasses of the Chen, et al. patent when in powder form can be compacted by standard powder metallurgy techniques. The resulting sintered products contain complex boride particles which are located primarily in the grain boundaries. The Ray application discloses additional alloys not disclosed in the Chen et al. patent which are suitable for formation of boride containing sintered metal parts. However, while the Ray application teaches that amorphous metals could be pulverized and employed as powders to make sintered crystalline parts, many of the alloys suggested by the Ray application when heated decompose by the formation of low melting eutectics. These eutectics can cause incipient melting and make the alloys unsuitable for many powder metal applications (e.g., high temperature applications). Furthermore, the resulting sintered parts have borides with highly variable stoichiometries. The mixture of borides of variable stoichsometries depends upon the composition of the alloy. The properties of many of the borides formed vary with stoichiometry. The effect of the borides on the properties of the sintered parts is unpredictable unless one can determine the mix of the boride stoichiometries.

The Polk et al. patent, U.S. Pat. No. 4,116,682 discloses a class of boron containing materials which are suitable for forming amorphous metals and not disclosed in the Chen et al. patent. The composition range suggested by Polk et al. will suffer from the same limitations as those of the Chen et al. patent and the Ray application in that the boride mix and incipent melting point cannot be predicted.

Herold et al. in an article in the Proceedings of Rapidly Quenched Metals III, 1978, entitled "The Influence of Metal or Metalloid Exchange on Crystallization of Amorphous Iron Boron Alloys" discusses the crystallization of amorphous iron boron alloys. In the composition region discussed, the author found different compounds depending on the composition and the thermal processing of the alloy. The study of Herold et al. did not suggest the use of powdered boron containing amorphous metals for powder metallurgy.

While the teachings of the Ray application will allow one to produce sintered parts having borides without necessitating the use of multiple components which must be blended to form the resultant powder, neither the teaching of the Ray application nor this teaching combined with the other teachings on amorphous metal alloys provide a range of compositions which assure freedom from incipient melting during the sintering process.

SUMMARY OF THE INVENTION

It is an object of this invention to provide an alloy which upon heat treatment decomposes into fine grain material with a boride phase distributed in the grain boundaries.

A further object of this invention is to provide an alloy which upon thermal treatment decomposes into a fine grain material with two chemically related boride phase having similar thermal, chemical, and mechanical properties.

It is another object of this invention to provide an alloy in amorphous powder form suitable for compaction and consolidation into sintered parts.

Still another object of this invention is to provide a polycrystalline metal powder homogeneous in chemistry suitable for compaction and consolidation into sintered metal parts.

A further object of this invention is to provide an alloy in powder form that is free from low incipient melting components and suitable for consolidation into sintered parts.

Still a further object of this invention is to provide an alloy in consolidated form which upon subsequent heat treatment will age harden.

These and other objects of the invention will be apparent from the description, figures and claims which follow.

The present invention is for a homogeneous single-phase, boride-free, age-hardenable, microcrystalline boron containing alloy, the composition of which can be essentially represented by the formula: $M_iT_jB_k$; where M is a metal from the group of nickel, iron, cobalt or a mixture thereof; T is a refractory metal from the group of molybdenum, tungsten, or a mixture thereof; and B is the element boron. The subscripts i, j, k are the respective atomic percent of each of the constituents and vary respectively between about 25 and 98, between about 1 and 40, and between 1 and 35 with the proviso that $j>k$, and $i+j+k=100$.

For ternary alloys the age hardenable region can be determined by assuming that all boron is contained in the borides and by treating the matrix as a pseudo binary alloy whose chemistry is determined by correcting to reflect the formation of the borides.

When it is desired to heat treat more complex alloys a pseudo ternary diagram for the M*-T*-B system is employed to predict the age hardening alloys. M* is the sum of the atomic percents of nickel, cobalt and iron; T* is the sum of the atomic percents of molybdenum and tungsten; and B is the atomic percent boron. The compositions falling within the area defined by a triangular region having its corners at: (83, 16, 1); (39, 33, 28); and (68, 31, 1) are age hardenable as depicted in FIG. 2.3.

BRIEF DESCRIPTION OF THE DRAWINGS

FIG. 2.1 illustrates the age hardenable regions claimed for the Co-Mo-B alloy system.

FIG. 2.2 illustrates the age hardenable region for Ni-Mo-B alloy system.

FIG. 2.3 illustrates the age hardenable regions for the Fe-Mo-B, the Ni-Mo-B, and the Fe-W-B alloy systems on a pseudo ternary diagram.

FIG. 3.1 is an X-ray diffractometer scan of a $Ni_{66.5}Mo_{23.5}B_{10}$ alloy which was cast in the amorphous state.

FIG. 3.2 is a bright field transmission electron micrograph of an amorphous $Ni_{66.5}Mo_{23.5}B_{10}$ alloy.

FIG. 3.3 is an electron diffraction pattern for an amorphous $Ni_{66.5}Mo_{23.5}B_{10}$ alloy.

FIG. 4.1 is an X-ray diffractometer scan of a $Ni_{66.5}Mo_{23.5}B_{10}$ alloy which was cast in the amorphous state and held at 620° C. for one hour, to transform the structure to the homogeneous microcrystalline state.

FIG. 4.2 is a bright field transmission electron micrograph of a homogeneous microcrystalline $Ni_{66.5}Mo_{23.5}B_{10}$ alloy obtained by holding the amorphous alloy at 620° C. for one hour.

FIG. 4.3 is an electron diffraction pattern of a homogeneous microcrystalline $Ni_{66.5}Mo_{23.5}B_{10}$ alloy obtained by holding the amorphous alloy at 620° C. for one hour.

FIG. 5.1 is an X-ray diffraction scan of a $Ni_{66.5}Mo_{23.5}B_{10}$ alloy which was cast in the amorphous state and held 800° C. for one hour to transform the alloy to a boride containing crystalline state.

FIG. 5.2 is a bright field transmission electron microscope micrograph of a boride containing crystalline $Ni_{66.5}Mo_{23.5}B_{10}$ alloy obtained by holding the alloy in the amorphous state at 800° C. for one hour.

FIG. 5.3 is an electron diffraction pattern of a boride containing crystalline $Ni_{66.5}Mo_{23.5}B_{10}$ alloy obtained by holding the amorphous alloy at 800° C. for one hour.

FIG. 7.1 is a photomicrograph of an unetched polished sample of a boride containing $Ni_{66.5}Mo_{23.5}B_{10}$ alloy. The sample was obtained by crystallization of an amorphous alloy.

FIG. 7.2 is a photomicrograph of an unetched polished sample of a boride containing $Ni_{66.5}Mo_{23.5}B_{10}$ alloy. The sample was obtained by the recrystallization of homogeneous microcystalline alloy.

FIG. 8.1 is an X-ray diffractometer scan of a $Ni_{66.5}Mo_{23.5}B_{10}$ alloy which was solution treated at 1100° C. for 1 hour.

FIG. 8.2 is a photomicrograph of an unetched polished sample of a $Ni_{66.5}Mo_{23.5}B_{10}$ alloy which was solution treated at 1100° C. for 1 hour.

FIG. 9.1 is an X-ray diffraction scan of a $Ni_{66.5}Mo_{23.5}B_{10}$ alloy which was solution treated at 1100° C. for 1 hour and then aged at 800° C. for 4 hours.

FIG. 9.2 is a photomicrograph of an unetched polished sample of a $Ni_{66.5}Mo_{23.5}B_{10}$ alloy which was solution treated at 1100° C. for 1 hour and then aged at 800° C. for 4 hours.

FIG. 10.1 is a transmission electron micrograph of a $Ni_{36}Fe_{41}Mo_{13}B_{10}$ alloy which was solution treated at 1050° C. for 2 hours.

FIG. 10.2 is a photomicrograph of an unetched polished sample of $Ni_{36}Fe_{41}Mo_{13}B_{10}$ alloy which was solution treated at 1050° C. for 2 hours.

FIG. 11.1 is a photomicrograph of an unetched polished sample of a $Ni_{82}Mo_8B_{10}$ alloy which was hot pressed at 1030° C.

FIG. 11.2 is a photomicrograph of an unetched polished sample of a $Ni_{82}Mo_2B_{10}$ alloy which was hot pressed at 1070° C.

FIG. 12 is a series of five graphs showing the hardness versus temperature for $Ni_{60}Mo_{30}B_{10}$, $Ni_{49}Mo_{31}B_{20}$, $Ni_{54}Mo_{26}B_{20}$, $Ni_{62}Mo_{23}B_{15}$, and a M-42 high speed steel.

BEST MODES OF CARRYING THE INVENTION INTO PRACTICE

Figure 1:
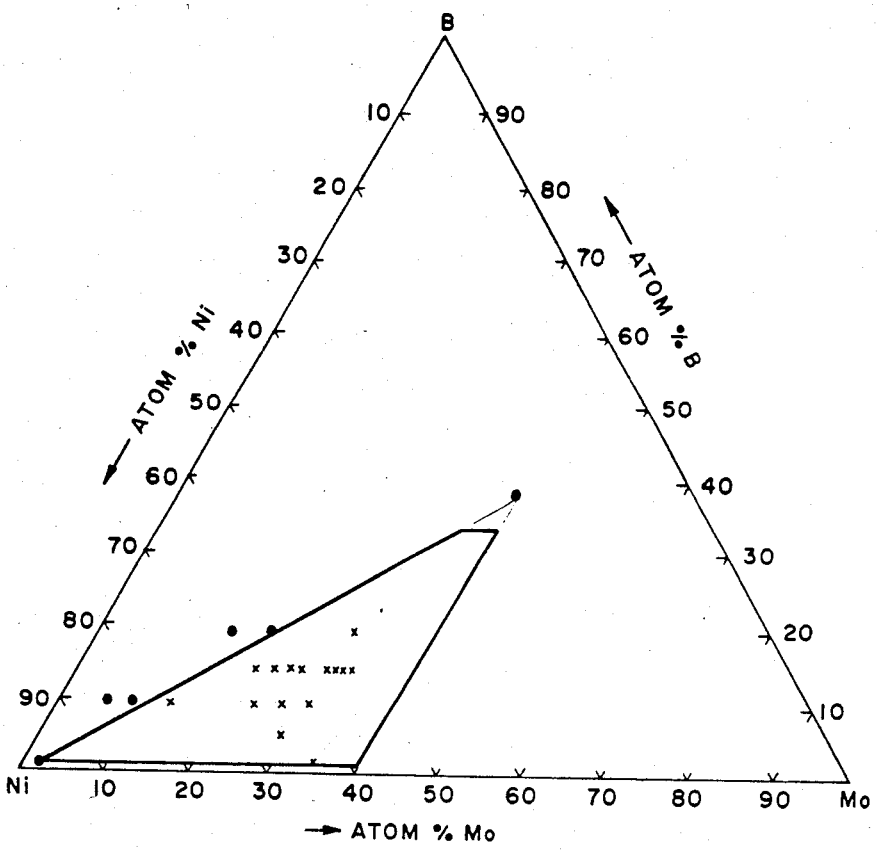
FIG. 1 is a ternary diagram for the nickel-molybdenum-boron system illustrating the region of the nickel-molybdenum-boron diagram claimed by one embodiment of the present invention.

A series of alloys were cast in ribbon form by impinging a jet of liquid metal onto a moving chill substrate in order to illustrate the merits resulting from employing alloys with the compositional range defined by:

$$M_iT_jB_k \qquad \text{(eqn 1)}$$

where: M is a metal from the group of nickel, iron, cobalt or a mixture thereof. T is a refractory metal selected from the group Mo, W, or a mixture thereof; B is the element boron; and i, j and k are the atomic percent of M, T and B and are between atomic percent of M, T and B and are between 25 and 98, 1 and 40, and 1 and 35 respectively with the proviso that $i+j+k=100$ and that $j>k$.

A copper wheel was employed as the chill substrate for the examples set forth below, however, it should be appreciated that other materials such as copper-beryllium, iron, and molybdenum are acceptable as materials for a chill substrate. This technique produced ribbons with a thickness of from about 0.02 mm to about 0.1 mm. When the thickness of the ribbon is maintained within these limits, the chill substrate effectively extracts heat from the ribbon and produces the rapid cooling rates (e.g., $10^4$° C./sec. or greater) necessary to produce the materials of the present invention. The ribbons cast may be either in the amorphous state or in the microcrystalline state. At the slower cooling rates the materials will be microcrystalline. In either case, the ribbons will be chemically homogeneous. For the purpose of this work, the materials shall be considered chemically homogeneous when the X-ray diffraction pattern is either that of an amorphous material or that of a single phase material, and there is no marked variation in the chemistry as a function of the sampling location. Another index of the chemical homogeneity is the lack of noticeable segregation in the alloys which might be expected to result from coring or dentritic growth of crystals during solidification. For all alloys of the present invention, no segregation was observed by either X-ray diffraction or transmission electron microscopy.

A series of alloys cast in ribbon form were studied and are summarized in Table 1. The chemistry of these alloys fell within, as well as, outside the range of the present invention; however, the chemistry of all the alloys fell within the scope of the Chen et al. patent and the Ray application. While the alloys summarized in Table 1 were cast on a 12 inch (30.48 cm) diameter copper wheel other rapid solidification techniques could be employed with the same resulting structures. These techniques include gun, piston and anvil, rotating double roll, splat, melt extraction, and melt drag techniques.

TABLE 1

Incipient Melting Temperatures of Alloys Inside and Outside of the Claimed Composition Range

| Alloy Composition (at %) | Alloys of Present Invention (yes or no) | Incipient Melting Point (°C.) |
|---|---|---|
| Ni—base Alloys | | |
| $Ni_{64}Mo_{35}B_1$ | Yes | 1240 |
| $Ni_{77}Fe_5Mo_{13}B_5$ | Yes | 1235 |
| $Ni_{67.5}Mo_{28.5}B_5$ | Yes | 1240 |
| $Ni_{78}Mo_{12}B_{10}$ | Yes | 1235 |
| $Ni_{63.5}Mo_{26.5}B_{10}$ | Yes | 1235 |
| $Ni_{66.5}Mo_{23.5}B_{10}$ | Yes | 1235 |
| $Ni_{60}Mo_{30}B_{10}$ | Yes | 1238 |
| $Ni_{67}Mo_9W_9B_{15}$ | Yes | 1295 |
| $Ni_{67}Mo_{20}W_3B_{10}$ | Yes | 1290 |
| $Ni_{62}Fe_{10}Mo_{18}B_{10}$ | Yes | 1260 |
| $Ni_{56.5}Fe_{10}Mo_{23.5}B_{10}$ | Yes | 1250 |
| $Ni_{70}W_{20}B_{10}$ | Yes | 1305 |
| $Ni_{54.5}Mo_{30.5}B_{15}$ | Yes | 1255 |
| $Ni_{56}Mo_{29}B_{15}$ | Yes | 1260 |
| $Ni_{60}Mo_{25}B_{15}$ | Yes | 1265 |
| $Ni_{59}Mo_{26}B_{15}$ | Yes | 1260 |
| $Ni_{53}Mo_{32}B_{15}$ | Yes | 1258 |
| $Ni_{55}Mo_{30}B_{15}$ | Yes | 1265 |
| $Ni_{62}Mo_{23}B_{15}$ | Yes | 1245 |
| $Ni_{64}Mo_{21}B_{15}$ | Yes | 1257 |
| $Ni_{49}Mo_{31}B_{20}$ | Yes | 1260 |
| $Ni_{98}Mo_1B_1$ | No | 1080 |
| $Ni_{82}Mo_8B_{10}$ | No | 1085 |
| $Ni_{85}Mo_5B_{10}$ | No | 1070 |
| $Ni_{65}Mo_{15}B_{20}$ | No | 1070 |
| $Ni_{60}Mo_{20}B_{20}$ | No | 1070 |
| Fe—Base Alloys | | |
| $Fe_{41}Ni_{36}Mo_{13}B_{10}$ | Yes | 1255 |
| $Fe_{52}Ni_{22.3}Co_{3.7}Mo_{12}B_{10}$ | Yes | 1260 |
| $Fe_{36}Ni_{30}Mo_{19}B_{15}$ | Yes | 1265 |
| $Fe_{72}W_{18}B_{10}$ | Yes | 1340 |
| $Fe_{77}W_{13}B_{10}$ | Yes | 1335 |
| $Fe_{70}W_{20}B_{10}$ | Yes | 1260 |
| $Fe_{75}Mo_{10}B_{15}$ | No | 1135 |
| $Fe_{60}Mo_{20}B_{20}$ | No | 1145 |
| Co—Base Alloys | | |
| $Co_{70}Mo_{20}B_{10}$ | Yes | 1250 |
| $Co_{75}W_{15}B_{10}$ | Yes | 1300 |
| $Co_{72}W_{18}B_{10}$ | Yes | 1335 |
| $Co_{82}Mo_8B_{10}$ | No | 1130 |
| $Co_{60}Mo_{20}B_{20}$ | No | 1130 |

The incipient melting points listed in Table I were obtained by DTA (differential thermal analysis). It becomes apparent from reviewing Table I that the alloys outside the range of the present invention but within the range of the Chen et al. patent and the Ray application have incipient melting points substantially below those of the alloys of the present invention. The incipient melting points of the nickel base alloys outside the range of the present invention were below 1080° C. The iron and cobalt base alloys outside the range of the present invention had incipient melting points typically less than about 1145° C. If alloys outside the range of the present invention are consolidated in the solid state, the incipient melting point places an upper limit on the processing temperature. This limit may make proper consolidation of the powder product difficult. Furthermore, when hot isostatic pressing (HIP) is employed, consolidation at temperatures above the incipient melting point can result in interaction with the canning material making consolidation impossible. Furthermore, even if consolidation were to be done at temperatures above the incipient melting point by other techniques such as hot pressing, the low melting constituents will be present in grain boundaries of the consolidated product. This will limit the temperature at which the sintered products can be employed and could cause a degradation of the properties of the resulting sintered material.

The alloys listed in Table 1 will have boron concentrations which do not exceed 20 at. %. The liquidius of these alloys rise rapidly with increasing boron content. At boron levels above about 20 at. % it is extremely difficult to find a crucible that is sufficiently refractory to contain the molten alloy, therefore it is preferred to maintain the boron content at levels equal to or below about 20 at. %.

FIG. 1 is a ternary diagram for the nickel-molybdenum-boron system. All percentages represented on the diagram are in atomic percent. The nickel-molybdenum-boron alloys of Table I have been plotted on the ternary diagram with those alloys having high incipient melting points, above 1200° C., being illustrated by x's while those with the low incipient melting points, below 1100° C., illustrated by dots. A preferred composition range of the present invention with a maximum of 35 at % B is defined by the quadrilateral shown in FIG. 1. It should be appreciated that if j=40 as k approached 40 the resulting material will be 100% boride and thus very brittle. It is preferred that the borides be bonded together with a metallic matrix to bond the borides. Therefore, the boride content is limited to about 35 atomic percent.

It should be noted that all of the alloys with high incipient melting points lie within the region claimed by the present invention. The alloys whose compositions plot onto the line joining the Ni corner of the diagram and the compound $Mo_2NiB_2$ lie outside the claimed range, since for the present invention the molybdenum content must exceed the boron content. It is preferred that the molybdenum content exceed the boron content by at least 2 atomic percent.

The alloys of the present invention can be cast into ribbons which are either amorphous or microcrystalline. Those alloys with compositions away from an eutectic composition are generally easier to form microcrystalline. The preferred chemistry for amorphous ribbons would have the boron content greater than about 5 atomic percent and less than about 20 atomic percent.

Whether an alloy of the present invention is cast in the amorphous or microcrystalline state depends on the casting parameters, as well as the chemistry. The most critical casting parameter is the cooling rate. This rate will be controlled by the surface velocity of the wheel and the temperature of the impinging stream. As the velocity of the wheel increases above a limit which is a function of the alloy chemistry, the ribbon tends to lift from the wheel, and the cooling rate is decreased.

When a polycrystalline material results, the grain size of the material is extremely fine, usually in the order of about 0.1 micron or less. The resulting material is free from any boride precipitates. Thus, the as cast material is homogeneous, whether in the amorphous or the microcrystalline state. Furthermore, the amorphous and microcrystalline materials of the present invention upon further thermal processing will transform to the same stable microstructure.

At high temperatures the stable microstructure consists of fine borides with the general formula $T_xMB_x$: where x is 1 or 2; M is a metal from the group of nickel, iron, cobalt or a mixture thereof; T is a refractory metal from the group of molybdenum, tungsten, or a mixture thereof; and B is the element boron; and a matrix which is a solid solution or a solid solution plus an intermetallic compound. Whether x is 1 or 2 will depend on the composition of the alloy. For the Ni-Mo-B, Ni-W-B and Fe-Mo-B systems, the boride will have x=2. For the Fe-W-B, Co-Mo-B, and Co-W-B systems for borides will have x=1 or 2 depending on the overall compositions of the alloy.

For all the above systems the matrix is fine grain and the borides are dispersed as fine particles in the grain boundaries. The borides whether x is 1 or 2, or a mixture thereof are the major contributor to the hardness and the strength of the resulting alloy.

For the six ternary alloy systems mentioned above, when a single boride phase is present it has been found the overall chemistry of the matrix can be determined by reducing the concentration of M and T by the amount which has combined with the boride. With this modification the matrix material can be treated as a quasi-binary for prediction of the phase or phases which comprise the matrix.

Amorphous ribbons of the present invention can be converted to microcrystalline ribbons by controlled heating. The temperature for this conversion should be between about 400° C. and about 960° C., and the time will vary between a few minutes and several hours depending on the temperature. By the appropriate selection of both time and temperature, it is possible to produce a material in the microcrystalline state which is free from borides. If the time or temperature exceed that which is required to convert the ribbon to the microcrystalline state, fine boride precipitates will begin to form. After a sufficiently long thermal exposure, the ribbons will be fully recrystallized into the stable microstructure with an equilibrium distribution of the boride particles. This microstructure is stable with respect to the boride distribution, as well as, the grain size of the matrix material since the borides are thermally stable and pin the grain boundaries of the matrix. For this reason, it is possible to heat treat the alloys without a loss of strength due to grain growth.

Some of the alloys of the present invention can be age hardened by an appropriate heat treatment which initiates precipitation of an additional phase within the matrix.

Table 2 summarizes the temperatures above which a solid solution with the structure of the M element is in equilibrium with a phase where the T component is greater than or equal to about 40.

TABLE 2

| Solutionizing Temperatures | | | | |
|---|---|---|---|---|
| Alloy system | Temp - above which solutionizing should be conducted | Phases M rich | T rich | |
| Ni—Mo | 910° C. | Ni(21% Mo) | MoNi | (50% Mo) |
| Ni—W | 970° C. | Ni(16.4 W) | W | (0.1% Ni) |
| Fe—Mo | 1200° C. | Fe | $Mo_2Fe_3$ | (40% Mo) |
| Fe—W | 1040° C. | Fe(4% W) | $W_2Fe_3$ | (40% W) |
| Co—Mo | 1020° C. | Co(15% Mo) | $Mo_6Co_7$ | (46% Mo) |
| Co—W | 1094° C. | Co(14% M) | $W_6Co_7$ | (46% W) |

If for example, the matrix material were a Co-Mo alloy which is an equilibrium with a ternary boride phase of the form CoMoB. Then the alloy should be solutionized above 1020° C., and the relevant portion of the ternary phase diagram would be as illustrated in FIG. 2.1. The points D, E & F are respectively the solubility of Mo in Co, the compound $Mo_6Co_7$, and the ternay boride MoCoB. The triangle formed by the lines joining these points is a region where the three phases of the corners are in equilibrium. The adjacent triangular region formed by the Co corner of the diagram and points D and F is a two-phase region of Co and MoCoB. Since the Mo solubility in Co decreases from the solutioning temperature to supersaturate the alloy with Co, and subsequently heat treat the quenched alloys to temperatures below the solutioning temperature to reject Mo from the quenched alloy. The rejection of the Mo will promote the formation of precipitates which are stable at temperatures below the solutioning temperature.

If the supersaturation of Co with respect to Mo becomes too low, adequate rejection of Mo by the Co solid solution will not occur. For this reason it is preferred for age hardening to have a composition that falls within the shaded quadralateral region of FIG. 2.1 with its corners at (93,6,1), (61,38,1), (38,34,28), and (43,31,28) where the indicies are respectively the atomic percents of Co, Mo, and B.

This ability to age harden vanishes as the Mo content is increased so that the overall composition falls within the triangle EFG. In this triangle, each of the phases is of fixed composition, and for this reason, decreasing the temperature will not change the composition of the phases.

Since the age hardening results from a precipitation from the supersaturated Co solid solution, the effectiveness of the age hardening will be proportional to the amount of Co solid solution in the matrix. Due to the quasi-binary character of the matrix, it is possible to calculate the fraction of Co solid solution phase in the matrix. When a line is drawn parallel to the Co-Mo side of the ternary diagrams intersecting the Mo-B side of the diagram at the overall boron concentration of the alloy, the overall composition will lie on this line. The fraction of the Co rich phase can be predicated in the three phase triangle by determining the length of the line segment between the overall composition and the line EF and comparing this to the total length of the line in the three phase region (e.g., dl/l). It is preferred that dl/l be not less than about 0.25. This establishes the line E'F which is the maximum Mo concentration for the age hardenable Co-Mo-B alloys. Note, if the alloy is at point F in FIG. 2.1, the material will be all boride. Since only the matrix (the non-boride component) can be heat treated, the alloy of composition F will not be heat treatable. It is preferred that the boron content be reduced by about 10% so as to assure a heat treatable component of the structure. It is thus preferred that the boron content of the Co-Mo-B alloy be limited to about 38 at% boron when a heat treatable alloy is sought.

The same heat treatable region will exist for the ternary diagram of Co-W-B since above 1094° C. the W-Co compounds have the same stoichiometry as the Mo-Co compounds.

If, for example, the matrix were a Ni-Mo alloy, then the boride in equilibrium would be $Mo_2NiB_2$. At about 910° C., the relevant portion of the ternary phase diagram would be as illustrated in FIG. 2.2.

The points H, I, J are, respectively, the solubility limit of Mo in Ni, the compound MoNi and the ternary boride $Mo_2NiB_2$. The triangle formed by the lines joining these points is a region where the three phases of the corners are in equilibrium. The adjacent triangular region formed by the Ni corner of the diagram and points H and J is a two-phase region where Ni and $Mo_2NiB_2$ co-exist. Since the Mo solubility in Ni decreases with temperature, it is possible to age harden quenched alloys by rejecting Mo to stable the alloy at lower temperature.

If the supersaturation of Ni with Mo becomes too low, adequate rejection of Mo by the Ni solids solution will not occur. It is also preferred that there be at least 25 at% of Ni solid solution phase. However, the limitations of equation 1 further restricts the compositions that are heat treatable to those where there will be at least 29% of the heat treatable phase. For these reasons, it is preferred for age hardening to have a composition that falls within the shaded quadrilateral of FIG. 2.2 with its corners at (83,16,1), (59,40,1), (25,40,35) and (28,37,35).

The heat treatable region for the Ni-W-B system will be the same as for the Ni-Mo-B systems. The intermetallic compound of the form MoNi does not exist; however, a three phase region $Ni+W_2NiB_2+W$ exists over a broader range of compositions than the three-phase region of the Ni-Mo-B system. While the Ni base and Co base matrix phases have been given by way of example of systems which age harden, the Fe base alloys may also be age hardened. Table 3 lists the solubility of the refractory metals in the Ni, Fe, and Co solid solution phases at the soluting temperature and at a lower temperature.

TABLE 3

Solubility of Refractory Metals in Ni, Fe, and Co

| System | Rep. Solutionizing temperature | Solubility of Refractory | Aging temp. | Solubility of Refractor |
|---|---|---|---|---|
| Ni—Mo | 910° C. | 21 | 700° C. | 13 |
| Ni—W | 970° C. | 16 | 700° C. | 13 |
| Fe—Mo | 1200° C. | 12 | 700° C. | 3.5 |
| Fe—W | 1040° C. | 4 | 700° C. | 1.4 |
| Co—No | 1020° C. | 15 | 700° C. | 5 |
| Co—W | 1094° C. | 12 | 700° C. | 4 |

The ternary borides which have been identified for the systems set forth in Table 3 and are summarized in Table 4.

TABLE 4

Ternary Borides

| System | Borides |
|---|---|
| Ni—Mo—B | $Mo_2NiB_2$ |
| Ni—W—B | $W_2NiB_2$ |
| Fe—Mo—B | $Mo_2FeB_2$ |
| Fe—W—B | WFeB, $W_2FeB_2$ |
| Co—Mo—B | MoCoB, $Mo_2CoB_2$ |
| Co—W—B | CoWB, $Co_2WB_2$ |

In the Fe-Refractory Metal-B system, the stable borides will depend on the system. For the Fe-Mo-B System, only the boride of the form $Mo_2FeB_2$ will exist. From Table 2, one can see that the first Fe-Mo compound to form will have 40 at% Mo and the maximum solubility for the Mo in Fe will be about 12%. Thus, the three-phase region will be defined by the triangle with the Mo solubility limit in Fe, the $Fe_3Mo_2$ and $Mo_2FeB_2$ as its corners. The heat treatable region associated with the Fe-Mo-B system is illustrated by the quadrilateral outlined by the dashed lines in FIG. 2.3 with its corner at (93,6,1), (67,32,1), (26,39,35) and (29,36,35). The heat treatable region has been developed based on the arguments set forth earlier with the upper limit on molybdenum being established by the requirement that at least 25% of a Ni phase saturated with Mo should exist at the solutionizing temperature. The coordinates of the ternary diagram of FIG. 2.3 have been generalized to facilitate the superposition of the heat treatable region of the Fe-W-B system and the Ni-Mo-B system onto the same diagram. This pseudo ternary diagram for the M*-T*-B system has M* as the sum of the atomic percent of nickel, cobalt, and iron; T* as the sum of the atomic percent of molybdenum and tungsten; and B as boron.

The three-phase region for the Fe-W-B system will be established by the limit of tungsten solubility in Fe, about 4% W, the intermetallic compound $Fe_3W_2$, and the ternary boride Fe-W-B. The associated heat treatable region is illustrated by the quadrilateral outlined by the broken lines with its corners at (93,6,1), (68,31,1), (39,33,28), and (43,29,28) as illustrated in FIG. 2.3.

While the above examples of heat treatable systems have been discussed in terms of ternary alloys, it should be appreciated that small partial substitution of related elements (e.g., Fe substituted for same Ni in the Ni-Mo-B system) may be made without affecting the heat treatable region. Furthermore, even in the case of highly alloyed systems, the intersection of all heat treatable regions on a generalized pseudo ternary diagram sho uld represent the minimum range of heat treatable alloy. This intersection is also the intersection of the heat treatable region of the Fe-W-B and Ni-Mo-B heat treatable regions illustrated by the triangular shaded region having its corners at (83,16,1), (39,33,28), and (68,31,1) as illustrated in FIG. 2.3.

By heating the above described heat treatable alloys between about 1,000° C. to 1,200° C. and quenching to room temperature, it is possible to supersaturate the matrix with the refractory metals. The temperatures for solutions can be achieved during consolidation procedures when the alloy is maintained at a high temperature and subsequently cooled to room temperature. It should be noted that for all the alloys of the present invention, it is possible to HIP at sufficiently high temperatures to fully solution the matrix without causing incipient melting, such is not the case with many of the alloys suggested in the Ray application. Subsequent to solution treatment, an aging treatment can be undertaken at a temperature between about 700° C. to 850° C. during which M-T intermetallic compounds will precipitate within the matrix. This age hardening will produce strengthening of the matrix and increase the hardness of the alloy.

The alloys of the present invention can only be cast with amorphous or microcrystalline structure if one dimension is reasonably small (e.g., less than 100 microns). If heavy sections are to be made, either thin ribbons or powders may be consolidated to the desired shapes. Relatively simple shades such as cylinders, discs etc. can be formed by coiling ribbon and thereafter compressing and heating. When ribbons are consolidated, it may be necessary to employ secondary consolidation operations such as extrusion or forging to produce a fully bonded product. For more complex shapes, it is frequently desirable to produce the alloy in powder form and thereafter consolidate the powder into final or near net shapes.

When the alloys are produced in ribbon form and it is desired to reduce the ribbon to powder, this may be accomplished by a variety of mechanical fragmentation techniques. These techniques include ball milling, hammer milling, and jet milling.

When powder is to be consolidated, it is preferrable that the powder have a particle size distribution of between about −35 and +325 mesh. The powders can be consolidated by a variety of conventional processes such as hot pressing, HIP, hot forging, hot extrusion or hot dynamic compaction. In general, the compaction temperature should be between about 1000° C. and 1150° C. with pressures of about 60 MPa to 200 MPa being applied for about one quarter of an hour to four hours.

The following examples are included for the purpose of illustrating various novel aspects of the present invention.

EXAMPLES 1–12

A series of alloys were cast; the compositions of which are summarized in Table 5. Each casting was made from 400 grams of raw materials. The alloys were induction melted in a quartz crucible. The casting temperature was in the range of from about 1400° C. to about 1600° C. The casting was conducted in a closed vacuum chamber. The melt was pressurized and forced through an orifice about 20 mil (0.05 cm) to 75 mil (0.19 cm) in diameter. The resulting metal jet impinged on a 12 inch (30.5 cm) diameter rotating copper wheel. The wheel rotated at about 160 to 500 rpm.

The cast ribbons were analyzed by X-ray diffraction to determine whether the ribbons were amorphous or microcrystalline. The results of these tests are summarized in Table 5.

TABLE 5

| | | X-ray analysis to determine the amorphous/microcrystalline state |
|---|---|---|
| Ex. No. | Alloy Composition (at %) | amorphous/microcrystalline state |
| 1 | $Ni_{64}Mo_{35}B_1$ | microcrystalline |
| 2 | $Ni_{77}Fe_5Mo_{13}B_5$ | " |
| 3 | $Ni_{66.5}Mo_{28.5}B_5$ | " |
| 4 | $Ni_{57}Mo_{23}B_{20}$ | " |
| 5 | $Ni_{66.5}Mo_{23.5}B_{10}$ | amorphous/microcrystalline |
| 6 | $Ni_{63.5}Mo_{26.5}B_{10}$ | amorphous |
| 7 | $Ni_{60}Mo_{30}B_{10}$ | amorphous/microcrystalline amorphous |
| 8 | $Ni_{56}Mo_{29}B_{15}$ | amorphous/microcrystalline amorphous |
| 9 | $Ni_{49}Mo_{31}B_{20}$ | amorphous/microcrystalline amorphous |
| 10 | $Ni_{56.5}Fe_{10}Mo_{23.5}B_{10}$ | amorphous/microcrystalline amorphous |
| 11 | $Fe_{41}Ni_{36}Mo_{13}B_{10}$ | amorphous/microcrystalline amorphous |
| 12 | $Co_{70}Mo_{20}B_{10}$ | amorphous/microcrystalline amorphous |

From examination of Table 5, it can be seen that those alloys having 5% or less boron and relatively high nickel generally cast in the microcrystalline state. Alloys with about 10% boron may be cast either amorphous or microcrystalline.

EXAMPLES 13–15

A series of three samples of $Ni_{66.5}Mo_{23.5}B_{10}$ were studied. Each of the three samples had a different thermal history. The first sample, Example 13, was an amorphous as cast ribbon. An X-ray diffractometer scan employing filtered CuK radiation was made. The scan is illustrated in FIG. 3.1 for this ribbon of Example 13 and shows a single broad peak in the neighborhood of $2\theta=45°$. This pattern is characteristic of amorphous materials. Likewise, the bright field transmission electron microscope (TEM) micrograph in FIG. 3.2 reveals the amorphous character of the sample and shows no crystallites. FIG. 3.3 is an electron diffraction (ED) pattern for the as cast sample. This ED pattern exhibits a diffuse hollow ring which is characteristic of amorphous materials.

Example 14 is an as cast alloy that was annealed at 620° C. for one hour. This produced a microcrystalline structure. FIG. 4.1 shows an X-ray diffraction scan of this sample which has two nickel solid solution peaks. These two peaks and the lack of a single broad peak at $2\theta=45°$ indicates the material is fully crystalline. The crystallinity of the material is further illustrated by FIG. 4.2 which is a TEM micrograph and shows the material has a grain size of approximately 200 Å. Furthermore, FIG. 4.2 shows the material to be a single-phase. The fact that the material is single-phase is further supported by the lack of additional peaks associated with a boride precipitate in the X-ray diffraction pattern of FIG. 4.1.

FIG. 4.3 shows an electron diffraction pattern for the material of Example 14. The pattern shows multiple rings which correspond to the simple FCC crystal structure of a nickel solid solution.

The material of Example 15 was made by heat treating an amorphous ribbon at 800° C. for one hour. This heat treatment resulted in a crystallized material containing the equilibrium phases. FIG. 5.1 is the X-ray diffraction pattern for Example 15 and shows the nickel solid solution peaks and the additional peaks associated with the nickel-molybdenum-boron compound $Mo_2NiB_2$. FIG. 5.2 shows a TEM micrograph of Example 15. The electron micrograph shows the dark boride particles and the light nickel-molybdendum solid solution matrix. An ED pattern of the material of Example 15 is shown in FIG. 5.3. This diffraction pattern has multiple rings which indicate the crystalline nature of the material. Those rings which are substantially continuous result from the matrix of nickel-molybdenum solid solution while the discontinuous rings arise from the boride particles.

The as cast alloy of Example 13 was characterized by using a differential scanning calorimeter and differential thermal analysis (DSC/DTA). The thermo scan is illustrated by curve D of FIG. 6. Two exothermo peaks at about 535° C. and 740° C. were observed. Both of these peaks were smooth indicating only one crystallization process occurred at each temperature. The 535° C. peak results from the transformation of the amorphous state to a nickel solid solution crystalline state. The 740° C. peak is associated with the precipitation of the nickel-molybdenum-boron compound.

Figure 6:
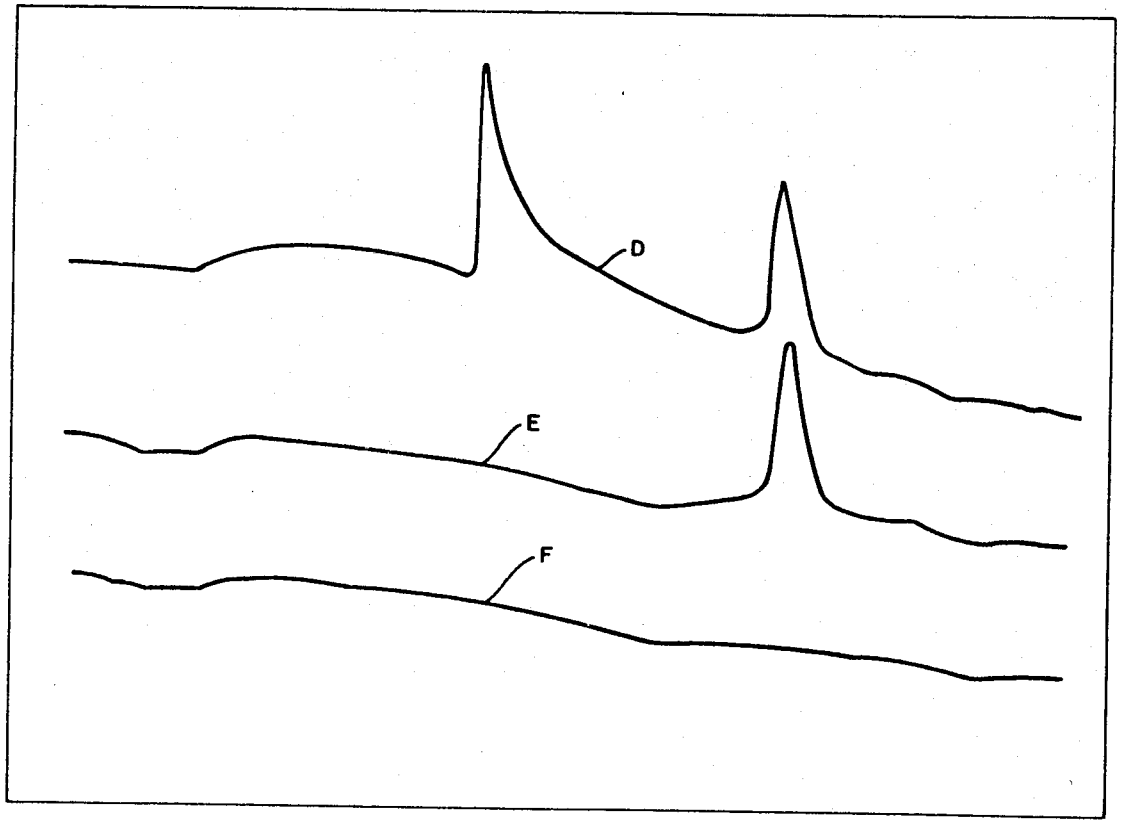
FIG. 6 shows three differential thermal analysis scans for $Ni_{66.5}Mo_{23.5}B_{10}$ alloys. The scans represent the alloy in the amorphous, homogeneous microcrystalline, and boride containing crystalline states.

A DSC/DTA scan of the material of Example 14 is shown by curve E in FIG. 6 and differs from Example 13 shown by the curve D in that the 535° C. peak has disappeared. The 740° C. peak for curve E is substantially the same as the 740° C. peak for curve D. The lack of the 535° C. peak in curve E and the similarity in the 740° C. peaks in curves D and E gives support to the fact that the transformation to the stable structure is a two stage process. The first stage results in the formation of a microcrystalline state while the second stage is the formation of the boride particles. For this reason, it is possible to form a microcrystalline material which is single phase and homogeneous.

When the material of Example 15 is examined by DSC/DTA, the analysis yields a smooth curve as is illustrated by curve F in FIG. 6 and does not have either the 535° C. peak or the 740° C. peak. The lack of peaks indicates that the material, when heat treated at 800° C., has fully transformed to the equilibrium phases.

EXAMPLES 16–17

Two sets of casting conditions were employed to illustrate the effect of casting parameters on the structure of $Ni_{66.5}Mo_{23.5}B_{10}$ ribbon. In both cases, a jet casting device was employed. A nozzle was maintained at a ¾ inch (1.9 cm) separation from 12 inch (30.5 cm) diameter copper casting wheel and the jet impinged on the wheel at an angle 5° removed from the normal. The gauge ejection pressure for casting was 2 psi (13.8 kPa). For the casting of Example 16, the alloy was heated to 1470° C. and cast onto the wheel which was rotated to provide lineal velocity of 5000 feet per minute (25.4 m/s). The material cast under these condition was amorphous. When the resulting ribbon was characterized by X-ray diffraction and transmission electron microscophy, the characterization was comparable to Example 13 reported in FIG. 3.

For Example 17, the casting temperature was 1600° C. and surface velocity of the wheel was 6500 feet per minute (33.02 m/s). When the casting speed was increased thereby reducing the time the metal ribbon was in contact with the wheel and when the pouring temperature was increased so that the cooling rate of the ribbon was decreased, a microcrystalline structure resulted. The characterization of the alloy of Example 17 was comparable to the heat treated ribbon illustrated in FIG. 4.

The samples of Examples 16 and 17 were heat treated at 1100° C. for two hours and optical micrographs, as well as transmission electron micrographs, were taken. The optical microstructures for the heat treated amorphous and microcrystallized materials of Examples 16 and 17 are illustrated in FIG. 7.1 and 7.2 respectively. FIG. 7 shows that the microstructure of the material after heat treatment is independent of the state of the original material.

EXAMPLES 18–23

Nine alloys were selected to illustrate the effect of composition on the age hardening characteristics. The compositions of the alloys are given in Table 3.

The alloys were cast on a wheel caster as described in the earlier examples. The higher boron alloys, Examples 21, 22, 25 and 26, were cast at a temperature between 1600° C. and 1650° C. The remaining alloys were cast at a temperature between about 1400° C. and 1500° C. Powders were prepared by mechanically pulverizing the ribbons to produce the following distribution of particle sizes:

−35 to +120 mesh: 40%
−120 to +230 mesh: 40%
−230 to +325 mesh: 20%

The powders were consolidated by Hipping at 1100° C. and with an applied pressure of 100 MPa (15000 psi) for a period of 2 hrs. The consolidated samples were then heat treated at a temperature adequate to fully solution the matrix. Subsequent to the solution treatment the alloys were given an age hardening treatment. The conditions for the solution treatment and aging treatment are given in Table 6.

TABLE 6

Process parameters for heat treatment of selected nickel molybdenum boron alloys

| | | Solution Treatment | | Aging Treatment | |
|---|---|---|---|---|---|
| Ex. | Alloy Compositon | temp/time | hardness (Rc) | temp/time | hardness (Rc) |
| 18 | $Ni_{66.5}Mo_{23.5}B_{10}$ | 1100° C./1 hr. | 48 | 800° C./4 hr. | 56 |
| 19 | $Ni_{63.5}Mo_{26.5}B_{10}$ | 1100° C./1 hr. | 49 | 825° C./4 hr. | 62 |
| 20 | $Ni_{60}Mo_{30}B_{10}$ | 1170° C./1 hr. | 52 | 800° C./4 hr. | 62 |
| 21 | $Ni_{56}Mo_{29}B_{15}$ | 1100° C./1 hr. | 55 | 800° C./4 hr. | 66 |
| 22 | $Ni_{49}Mo_{31}B_{20}$ | 1100° C./1 hr. | 58 | 800° C./4 hr. | 67 |
| 23 | $Ni_{66.5}Fe_{10}Mo_{23.5}B_{10}$ | 1100° C./1 hr. | 48 | 825° C./4 hr. | 52 |
| 24 | $Co_{70}Mo_{20}B_{10}$ | 1100° C./1 hr. | 57 | 700° C./16 hr. | 64 |
| 25 | $Ni_{62}Mo_{23}B_{15}$ | 1100° C./1 hr. | 54 | 800° C./4 hr. | 54 |
| 26 | $Ni_{54}Mo_{26}B_{20}$ | 1100° C./1 hr. | 60 | 800° C./4 hr. | 60 |

As can be seen from Table 6, the first seven alloys showed an increase in hardness after the aging treatment while the latter two did not age harden. The first seven alloys fall within the age hardenable regions of FIG. 2.1 through FIG. 2.3 while the remainder are outside these regions.

The alloy $Ni_{66.5}Mo_{23.5}B_{10}$, Example 18, was selected to illustrate the effect of age hardening on the resulting structure of the material since the results can be directly compared with the earlier examples. FIG. 8 shows the X-ray diffraction pattern and an optical micrograph of the solution treated sample. By indexing the d-spacing of the X-ray diffraction pattern shown in FIG. 8-1, it was found that the material consists of two phases, a Ni-Mo solid solution which is primarily nickel, and the ternary boride compound with the formula $Mo_2Ni\ B_2$. The optical micrograph in FIG. 8.2 reveals borides, that are approximately 1 to 2 microns in size and are distributed in the grain boundaries. The hardness of this solution treated sample is Rc 48.

FIG. 9 shows the x-ray diffraction scan and microstructure of Example 18 after it was solution treated and aged at 800° C. for 4 hours. Extra peaks, in the X-ray diffraction scan shown in FIG. 9.1, correspond to the d-spacings of the intermetallic compounds $Ni_3Mo$ and $Ni_4Mo$. These lines appear in addition to the Ni-Mo solids solution and $Mo_2NiB_2$ boride lines shown in FIG. 8.1. The microstructure is shown in FIG. 9.2 and does not seem changed when compared to that of the solution treated sample (see FIG. 8.2), however, the hardness of this aged sample increased to Rc 56. It should also be noted when comparing FIGS. 8.2 and 9.2 that, although FIG. 9.2 was heated for substantially longer periods of time than the structure of 8.2, the additional heating did not change either the size or distribution of the borides. This is further evidence of the stability of the boride phase. This stability allows one to approximate the matrix material by a quasi binary alloy. This allows one to approximate the age hardening characteristics of an alloy from the binary phase diagrams of iron-molybdenum and nickel molybdenum if the matrix composition is corrected for the depletion of alloy which occurs when the borides are formed.

Although the age hardening process increases the hardness of the alloys, it decreases the toughness. This occurs because the matrix before age hardening is a tough nickel-molybdenum solid solution, and in the age hardened condition contains a hard brittle intermetallic phase. The difference in the ductility of these alloys is illustrated by the effect of age hardening on the impact strength. For purposes of illustration, $Ni_{60}Mo_{30}B_{10}$ was tested for impact strength before and after age hardening. These results are reported in Table 7. For each case the impact strength reported is an average of three samples. The tests were done under standard Charpy un-notched test conditions.

TABLE 7

Effect of heat treatment on impact strength

| thermo-treatment | hardness (Rc) | Impact strength (ft-lb) |
|---|---|---|
| Solution treated | 52 | 29 |
| Solution treated and aged | 62 | 4.5 |

EXAMPLE 27

An alloy of $Ni_{36}Fe_{41}Mo_{13}B_{10}$ was prepared in powder form by the methods described above. The distribution in the powder size was as follows:

−35 to +120 mesh 40%
−120 to +230 mesh 50%
−230 to +325 mesh 10%

The powder was then compacted by Hipping at 1050° C. under a pressure of 100 MPa. (15,000 psi) for 2 hours. Thereafter the product was thermally treated at 1050° C. for two hours. The temperature of 1050° C. was selected to assure that the matrix would be a solid solution. The microstructure of the material is shown in FIG. 10. FIG. 10.1 is an electron micrograph. The dark regions are mostly the ternary borides which are of the form $Mo_2(FeNi)B_2$ where the Fe and Ni are substitutional in the ternary boride. FIG. 10.2 shows an optical micrograph of the structure. It can be seen that the borides are well dispersed throughout the material. It also should be noted that iron substitution for nickel in the boride tends to spherodize the boride.

EXAMPLES 28–29

Ribbons of two of the alloys reported in Table 2 ($Ni_{82}Mo_8B_{10}$ and $Ni_{65}Mo_{15}B_{20}$) which lie outside the claimed invention were pulverized to powders with the maximum mesh size of 35 mesh and a distribution as follows:

−35 to +120 mesh 40%
−120 to +230 mesh 50%
−230 to +325 mesh 10%

From Table 2 it can be seen that the $Ni_{82}Mo_8B_{10}$ has an incipient melting temperature of 1085° C. A sample weighing 10 gm, was consolidated by hot pressing at a temperature of 1030° C., 55° below the incipient melting temperature to assure that incipient melting did not occur. The microstructure of this sample is shown in FIG. 11.1. As can be seen from examining FIG. 11.1, the material is poorly consolidated there are voids which appear as dark images as well as traces of the residual powder grain boundaries.

When the $Ni_{82}Mo_8B_{10}$ sample is consolidated at about 1090° C. there is incipient melting as is illustrated in FIG. 11.2. The rounded grains are surrounded by white regions which are a low melting constituent and indicate incipient melting of the pressed powder.

Two 10 gram samples of $Ni_{65}Mo_{15}B_{20}$ which has an incipient melting temperature of 1070° C. as reported in Table 2 were hot pressed at 1030° C. and 1070° C. respectfully. The resulting microstructures had similar characteristics to those shown in FIG. 11 for the $Ni_{82}Mo_8B_{10}$ alloy. The material consolidated below the incipient melting temperature showed porosity while the sample consolidated at the incipient melting temperature showed that incipient melting had occurred.

EXAMPLES 30–33

Cutting tools were prepared from the following four alloys shown in Table 8.

TABLE 8

Composition and aging temperatures for selected cutting tool alloys

| Examples | Composition | Aging Temperature |
|---|---|---|
| 30 | $Ni_{62}Mo_{23}B_{15}$ | not aged |
| 31 | $Ni_{54}Mo_{26}B_{20}$ | not aged |
| 32 | $Ni_{49}Mo_{31}B_{20}$ | 800° C.–850° C. |
| 33 | $Ni_{60}Mo_{30}B_{10}$ | 800° C.–850° C. |

The cutting tools were fabricated into rods by Hipping the powder at 1100° C. at a pressure of 100 MPa (15,000 psi) for a period of 2 hours. The resulting consolidated materials were solution treated between 1050° C. and 1200° C. The solution treated rods were machined to form a single point turning tool. Examples 32 and 33 were aged at the temperatures given in Table 5. The hot hardness of these materials as a function of temperature was determined for each of the alloys and is given in FIG. 12. For comparison the hot hardness of a M-42 high speed tool steel is also reported in FIG. 12. The composition of the M-42 steel is as follows:

$Fe_{bal}Cr_{3.75}V_{1.15}W_{1.5}Mo_{9.5}Co_{8.0}C_{1.1}$ (wt %).

Figure 13:
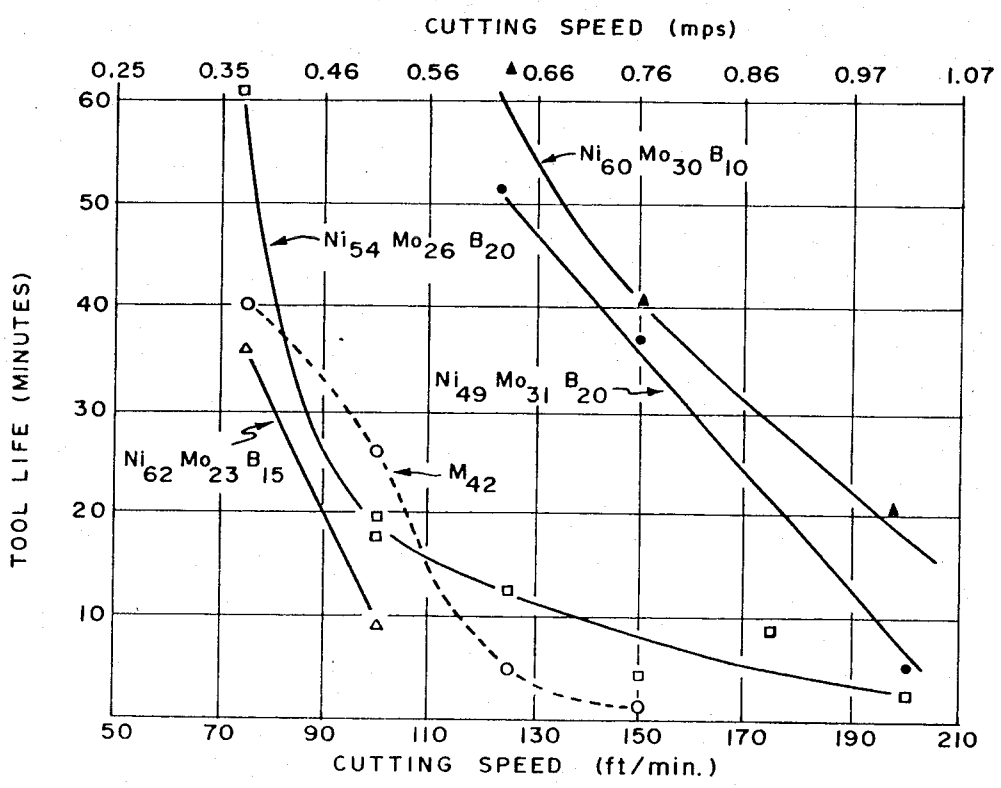
FIG. 13 is a series of five graphs showing tool life versus cutting speed for $Ni_{60}Mo_{30}B_{10}$, $Ni_{49}Mo_{31}B_{20}$, $Ni_{54}Mo_{26}B_{20}$, $Ni_{62}Mo_{23}B_{15}$, and a M-42 high strength steel.

The cutting characteristics of the single point tools were tested by turning 4330 steel quenched and tempered to Brinell hardness 302. The feed rate was 0.10 inches per revolution, the cutting depth was 0.100 inches, and the cutting fluid was a soluable oil in water with a ratio of 1:20. The tool was considered failed when there was 0.060 inches (0.15 cm) of wear. The results of these tests are given in FIG. 13. The non-age hardenable materials in general performed as well as the M-42 high speed steel. Those alloys which were age hardenable were in general superior to the non-age hardenable materials and the high speed steel.

EXAMPLE 34

A sample was made by thermo-mechanical processing of powders of a nickel base alloy having the composition $Ni_{56.5}Fe_{10}Mo_{23.5}B_{10}$. Powder of the above composition and with particle size less than 35 mesh was packed in a mild steel can and Hipped at temperatures between 1050° C.–1100° C. at a pressure of about 100 MPa (15,000 psi) and held at temperature and pressure for about 2 hours. The resulting sample was decanned and tested for its physical properties at room temperature and elevated temperatures. The results are given in Table 9. The sample showed excellent hot hardness, hot strength and wear characteristics. Extrusion dies made of this material were field tested and compared against a commonly used conventional alloy Stellite 6. Dies made of the alloy of Example 34 offered more than twice the die life as was obtained by Stellite 6 for the extrusion of copper.

TABLE 9

| Alloy | Average Tensile Data: Test Temp. °F. | Ultimate Tensile Strength KSI | Yield Strength at 0.2% off-set KSI | Hardness Rc |
|---|---|---|---|---|
| $Ni_{56.5}Fe_{10}Mo_{23.5}B_{10}$ | RT | 205 | 155 | 50 |
| | 600 | 192 | 145 | 50 |
| (Example 34) | 1000 | 182 | 130 | 49 |
| | 1400 | 132 | 84 | 31 |
| $Co_{bal}Cr_{30}W_5Mo_{1.5}$ | RT | 154 | 93 | 45 |
| $Si_{2.0}Fe_{3.0}Mn_{2.0}C_{1.7}$ | 600 | 148 | 75 | 43 |
| (wt %) | | | | |
| (Stellite 6) | 1000 | 129 | 67 | 36 |
| | 1400 | 80 | 50 | 27 |

| Property | Average Property Data: Stellite 6 | Example 34 |
|---|---|---|
| Av. Modulus of Elasticity | $29 \times 10^6$ psi | $31 \times 10^6$ psi |
| Av. Charpy V-notch Impact | 4.0 Ft-Lb | 3.5 Ft-Lb |
| Av. Abrasive Wear, $cm^3$/rev. | 32.5 | 34 |

We claim:

1. A single-phase, boride-free, homogeneous age hardenable microcrystalline alloy consisting of a composition restricted such that the composition is within a region of a pseudo ternary diagram for the M*-T*-B system, where M* is the sum of the atomic percents of Ni, Co and Fe; and T* is the sum of the atomic percents of Mo and W, said region of said pseudo ternary diagram being defined by a triangle having its corners at:

(83, 16, 1)

(39, 33, 28), and (68, 31, 1)

where the indicies are respectively M*, T* and B.

2. The alloy of claim 1 wherein said alloy is in powder form.

3. The powder of claim 2 wherein the mesh size range is between about −35 and +325.

4. A single-phase, boride-free, homogeneous age-hardenable microcrystalline alloy consisting essentially of a composition restricted such that the composition is within a quadrilateral region of the ternary diagram for the Ni-Mo-B system having its corners at:

(83, 16, 1), (28, 37, 35), (25, 40, 35), and (59, 40, 1);

where the indicies are, respectively, the atomic percent of Ni, Mo, and B.

5. The alloy of claim 4 wherein said alloy is in ribbon form.

* * * * *